US006195522B1

(12) United States Patent
Sato

(10) Patent No.: US 6,195,522 B1
(45) Date of Patent: Feb. 27, 2001

(54) DEVELOPING DEVICE

(75) Inventor: Shougo Sato, Seto (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/407,895

(22) Filed: Sep. 29, 1999

(30) Foreign Application Priority Data

Nov. 24, 1998 (JP) ..... 10-332714
Feb. 8, 1999 (JP) ..... 11-030532

(51) Int. Cl.[7] ..... G03G 15/08
(52) U.S. Cl. ..... 399/284
(58) Field of Search ..... 399/274, 284

(56) References Cited

U.S. PATENT DOCUMENTS 4,656,965 * 4/1987 Hosoya et al. ..... 399/284
5,057,871 * 10/1991 Hirose et al. ..... 399/284 X
5,076,201 * 12/1991 Nishio et al. ..... 399/284 X
5,191,170 * 3/1993 Yoshida et al. ..... 399/284
5,752,146 * 5/1998 Sato ..... 399/284
6,021,297 * 2/2000 Campbell et al. ..... 399/284

FOREIGN PATENT DOCUMENTS

B2-6-52448 7/1994 (JP) .

* cited by examiner

*Primary Examiner*—Fred L. Braun
(74) *Attorney, Agent, or Firm*—Oliff & Berridge, PLC

(57) ABSTRACT

An image forming device has an image regulating structure including a thickness-regulating blade that makes contact with a developing roller. Toner applied to the developing roller passes between the layer thickness-regulating blade and the developing roller to form a thin toner layer on the developing roller. The amount of toner allowed to pass between the layer thickness-regulating blade and the developing roller is controlled by having the coefficient of friction between the blade and the toner greater than the coefficient of friction between the developing roller and the toner and by applying an electric force field from the blade to the developing roller. The application of the electric force effectively increases the coefficient of friction between the developing roller and toner to a degree to pass the thin layer of toner between the layer thickness-regulating blade and the developing roller.

20 Claims, 10 Drawing Sheets

Fig.10

RESULTS OF COMPARATIVE EXPERIMENT

| NIGROSINE | Q/M OF TOWER ON THE DEVELOPING ROLLER | FOGGING ON THE PHOTOSENSITIVE DRUM |
|---|---|---|
| 0. 1wt% | 5μC/g | 10. 3 |
| 0. 2wt% | 8μC/g | 7. 7 |
| 0. 3wt% | 15μC/g | 5. 6 |
| 0. 4wt% | 21μC/g | 4. 6 |
| 0. 45wt% | 26μC/g | 3. 9 |
| 0. 5wt% | 29μC/g | 4. 2 |
| 0. 6wt% | 32μC/g | 3. 3 |
| 0. 7wt% | 31μC/g | 3. 6 |

Fig.11

RESULTS OF EXPERIMENT ACCORDING TO THE SECOND EMBODIMENT

| NIGROSINE | Q/M OF TOWER ON THE DEVELOPING ROLLER | FOGGING ON THE PHOTOSENSITIVE DRUM |
|---|---|---|
| 0. 1wt% | 8μC/g | 6. 3 |
| 0. 2wt% | 13μC/g | 4. 2 |
| 0. 3wt% | 20μC/g | 3. 2 |
| 0. 4wt% | 27μC/g | 1. 6 |
| 0. 45wt% | 30μC/g | 1. 0 |
| 0. 5wt% | 33μC/g | 0. 8 |
| 0. 6wt% | 37μC/g | 0. 5 |
| 0. 7wt% | 36μC/g | 0. 9 |

DEVELOPING DEVICE

BACKGROUND OF THE INVENTION

1. Field of Invention

The invention relates to a developing device for forming a thin developer layer on a developer carrying member by use of a layer thickness-regulating member.

2. Description of Related Art

In a conventional developing apparatus that uses a non-magnetic one-component developer (hereinafter referred to as toner), a thickness-regulating blade made of rubber elastically makes contact with the developing roller to regulate the amount of toner passing between the layer thickness-regulating blade and the developing roller, and thereby a thin toner layer is formed.

For example, Japanese Patent Application Publication No. 60-205472 discloses a technique in which a coefficient of kinetic friction between the layer thickness-regulating blade and the toner is set to be greater than a coefficient of internal friction between toner particles, and the coefficient of kinetic friction between the layer thickness-regulating blade and the toner is set to be greater than that between the developing roller and the toner. By the technique disclosed in this publication, a thin toner layer can be formed on the surface of the developing roller due to a mechanical force, that is, a shearing force.

However, in the technique disclosed in this publication, no consideration is given to the action of an electrostatic force generated when the toner is charged due to friction between toner particles and friction between the toner and the developing roller or the layer thickness-regulating blade. Thus, in the above-mentioned technique where the layer thickness-regulating blade made of rubber elastically makes contact with the developing roller, normally charged toner along with uncharged toner and toner weakly charged to opposite polarity pass between the layer thickness-regulating blade and the developing roller, and are supplied to the surface of a photoconductive drum. When such abnormally charged toner is supplied to the photoconductive drum, it adheres to positions other than where it should adhere, resulting in so-called fogging, which denotes a problem that the toner adheres lightly over the background of an image and reduces image quality.

In view of the foregoing, an object of the invention is to provide a developing device that can form a uniform thin toner layer and eliminate fogging.

SUMMARY OF THE INVENTION

To solve the problem associated with the prior art, a developing device according to the invention is structured such that a layer thickness-regulating member is electrically conductive, and that a coefficient of friction produced between the layer thickness-regulating member and toner is greater than that between the surface of a developer carrying member and the toner, and further that a polarized electric field is generated, which applies to normally charged toner a force directed from the regulating member to the developer carrying member.

With this structure, the toner supplied to a pressed portion, where the regulating member is pressed against the developer carrying member, is affected by a friction force produced between the toner and the developer carrying member and that produced between the toner and the regulating member. Since the coefficient of friction produced between the regulating member and the toner is set to be greater than that between the developer carrying member and the toner, a greater friction force is exerted on the toner by the regulating member than by the developer carrying member. Accordingly, when no other forces than the friction forces are exerted on the toner, the toner is stopped from passing between the regulating member and the developer carrying member.

However, since the regulating member is made from an electrically conductive material, a polarized electric field is generated, which applies to normally charged toner a force directed from the regulating member to the developer carrying member. Accordingly, when normally charged toner is sandwiched between the regulating member and the developer carrying member, the force exerted on the normally charged toner by the electric field will counteract the friction force produced between the regulating member and the normally charged toner. Thus, that friction force becomes smaller than that produced between the developer carrying member and the normally charged toner, thereby allowing the normally charged toner to pass smoothly between the regulating member and the developer carrying member.

Consequently, the normally charged toner is supplied to the surface of the developer carrying member and a uniform thin toner layer is formed. On the other hand, since toner weakly charged to opposite polarity or uncharged toner is not affected by the action of the electric field, the friction force produced between the regulating member and the abnormally charged toner becomes greater than that produced between the surface of the developer carrying member and the abnormally charged toner. Thus, the abnormally charged toner is stopped from moving to the developer carrying member and from passing between the developer carrying member and the regulating member.

As described above, according to the invention, only normally charged toner passes between the regulating member and the developer carrying member, and other toner does not pass therebetween. Accordingly, only normally charged toner is supplied to an electrostatic latent image carrying member, and thereby excellent image quality can be maintained without producing fogging.

Further, when the regulating member is arranged to make surface contact with the developer carrying member, the contact area therebetween increases. The toner is frictionally charged over a large area efficiently while sandwiched by the regulating member and the developer carrying member.

Accordingly, uncharged toner or toner charged to opposite polarity is reduced in amount, such toner is less used for the developing process, and, as a result, fogging is more reliably prevented.

Further, when an electrically conductive member having rubber elasticity is used as the regulating member, the toner will be slow in deteriorating even when image forming operations are performed repeatedly.

Specifically, the regulating member having rubber elasticity deforms along the shapes of additives which are fine particles of silica or titanium oxide added to the surface of each toner particle, and no excessive pressure is applied to the additives. Accordingly, the additives can be prevented from being buried in the toner particles. In addition, since the member having rubber elasticity generally has a higher friction coefficient than metal or resins, that member is more likely to apply frictional charge to the toner, and the ratio of normally charged toner can be increased. Thus, the amount of toner charged to opposite polarity or uncharged toner can be reduced, and thereby fogging can be reduced.

In addition, when the regulating member is an electrically conductive member, an electric field can be generated between the regulating member and the conductive member reliably by an electric field generating means, and normally charged toner is allowed to pass smoothly between the regulating member and the developer carrying member.

Further, according to the invention, the developer carrying member is electrically conductive, and a coefficient of friction between at least the surface of the developer carrying member and the toner is set to be greater than a coefficient of friction $\mu i$ between the toner particles. At least a contact portion of the regulating member, which makes contact with the developer carrying member is electrically insulative, and a coefficient of friction $\mu b$ between the regulating member and the toner is set to be greater than the coefficient of friction $\mu r$ between the surface of the developer carrying member and the toner.

With the relationships, the toner supplied to the pressed portion, where the regulating member is pressed against the developer carrying member, is affected by a friction force from the developer carrying member. Also, the toner is affected by a friction force from the contact portion of the regulating member. The toner in the pressed portion is not a single particle but forms layers of toner particles having a predetermined thickness. Accordingly, toner particles directly affected by the friction force from the developer carrying member are also affected by that from other toner particles, while toner particles directly affected by the friction force from the regulating member are also affected by that from other toner particles. Among the toner particles constituting the layers, some of them are only affected by other toner particles.

Further, the coefficient of friction $\mu b$ between the contact portion of the regulating member and the toner is set to be greater than the coefficient of friction $\mu r$ between the surface of the developer carrying member and the toner, and the coefficient of friction $\mu r$ between the surface of the developer carrying member and the toner is set to be greater than the coefficient of friction $\mu i$ between the toner particles ($\mu b > \mu r > \mu i$).

Accordingly, if no other forces than the friction forces are exerted on the toner, toner particles being in contact with the surface of the developing carrying member are affected, as the developer carrying member rotates, by the friction force from the developer carrying member, which is greater than that from other toner particles, and held and carried by the developer carrying surface. On the other hand, toner particles being in contact with the contact portion of the regulating member are affected by the friction force from the contact portion, which is greater than that from other toner particles, and stopped from moving.

Since the coefficient of friction $\mu i$ between the toner particles in the intermediate layers away from the developer carrying member and the regulating member is very small, the toner layers will shear and be divided into toner particles carried by the rotation of the developer carrying member and those stopped from moving. The toner layers, if sheared repeatedly in this way, finally become a single layer which makes contact with both the surface of the developer carrying member and the regulating member. However, since the coefficient of friction $\mu b$ between the regulating member and the toner is greater than the coefficient of friction $\mu r$ between the developer carrying member and the toner, the toner is not allowed to pass the pressed portion.

As described above, on the assumption that no other forces than the friction forces are exerted on the toner, none of the toner can pass the pressed portion. However, since at least the surface of the developer carrying member is electrically conductive, when that surface makes contact with frictionally charged toner, charge opposite in polarity to the charged toner is induced on the surface. Thus, an image force is exerted on the toner from the regulating member to the developer carrying member.

On the other hand, since the contact portion of the regulating member is formed of an electrically insulative member, even when charged toner makes contact with the contact portion, less charge is induced on the regulating member to attract the charged toner than on the developing carrying member. Thus, a sufficiently small image force is exerted on the toner from the developer carrying member to the regulating member. Due to such a difference in image force, as far as the normally charged toner is concerned, vertical drag produced between the developer carrying member and the toner becomes sufficiently greater than that produced between the regulating member and the toner. As a result, the friction force produced between the toner and the developer carrying member is counteracted.

Accordingly, since the normally charged toner is greatly affected by the friction force from the developer carrying member, it passes between the developer carrying member and the regulating member while being held by the developer carrying member, and a uniform thin toner layer is formed on the surface.

In contrast, an insufficient image force directed from the regulating member to the developer carrying member is exerted on the toner charged to polarity opposite to the normally charged toner or uncharged toner. Thus, such toner is more affected by the friction force from the regulating member than that from the developer carrying member, and is not allowed to pass between the regulating member and the developer carrying member.

Accordingly, only normally charged toner is allowed to pass therebetween and formed into a uniform thin layer on the surface of the developer carrying member, and then supplied to the electrostatic latent image carrying member. Since poorly charged toner is not allowed to pass therebetween, so-called fogging is eliminated and a high quality image can be obtained.

The coefficient of friction $\mu b$ between the contact portion of the regulating member and the toner will not change even when the contact portion becomes worn by making sliding contact with the toner. Accordingly, the relationship between the coefficients of friction $\mu b$ and $\mu r$ between the surface of the developer carrying member and the toner will be maintained, and fogging can be prevented over such a long period of time that the contact portion becomes worn.

Further, for the toner located on the developer carrying member, downstream from the pressed portion and upstream from the developing area in the toner feed direction, the absolute value of the amount of charge per unit weight of the toner is adjusted to as high as 30 $\mu$C/g or more, using a charge control additive. Accordingly, the image force exerted on the toner from the regulating member to the developer carrying member becomes sufficiently greater than that from the developer carrying member to the regulating member. Due to such a difference in image force, as far as the toner charged to 30 $\mu$C/g or more is concerned, the vertical drag produced between the developer carrying member and the toner becomes greater than that between the regulating member and the toner. As a result, the friction force produced between the toner and the regulating member is counteracted.

Accordingly, since the toner charged to 30 $\mu$C/g or more is greatly affected by the friction force from the developer carrying member, it passes smoothly between the developer carrying member and the regulating member while being held by the developer carrying member.

In contrast, the image force directed from the regulating member to the developer carrying member is not sufficiently exerted on the toner charged to opposite polarity or uncharged toner. Thus, such toner is more affected by the friction force from the regulating member than that from the developer carrying member, and is not allowed to pass between the regulating member and the developer carrying member.

Accordingly, only the toner charged to 30 $\mu$C/g or more is allowed to pass therebetween and formed into a uniform thin layer on the surface of the developer carrying member, and then supplied to the electrostatic latent image carrying member. Since poorly charged toner is not allowed to pass therebetween, so-called fogging can be eliminated and a high quality image can be obtained.

Further, by adjusting the 10-point average roughness of the developer carrying member to be smaller than the average toner particle diameter, uncharged toner or toner weakly charged to opposite polarity can be prevented from being forcibly carried by the developer carrying member. In other words, poorly charge toner can be prevented from being carried to the electrostatic latent image carrying member while being trapped by the projections and recesses of the surface of the developer carrying member.

Further, using polymerized toner, which is excellent in fluidity and greatly affected by the electric field, is very effective for ensuring only the normally charged toner passes between the regulating member and the developer carrying member.

BRIEF DESCRIPTION OF THE DRAWINGS

A preferred embodiment of the present invention will be described in detail with reference to the following figures wherein:

FIG. 4A shows a plate-shaped sample blade made from the same material as that of the layer thickness-regulating member and bent to the same curvature as that of the developing roller, and FIG. 4B shows a sample blade made from the same material as the material of the layer thickness-regulating blade using a mold having the same curvature as that of the developing roller;

FIGS. 9A and 9B are drawings showing shapes of exemplary layer thickness-regulating blades applicable to the measuring method of FIG. 8, wherein FIG. 9A shows a plate-shaped sample blade made from the same material as that of the layer thickness-regulating member and bent to the same curvature as that of the developing roller, and FIG. 9B shows a sample blade made from the same material as that of the layer thickness-regulating blade using a mold having the same curvature as that of the developing roller;

FIG. 10 is a table showing the results of an experiment with a comparative device;

FIG. 11 is a table showing the results of an experiment conducted using the image forming apparatus according to the second embodiment of FIG. 6;

DETAILED DESCRIPTION OF PREFERRED EMBODIMENTS

Preferred embodiments according to the invention will be described with reference to the attached drawings.

Figure 1:
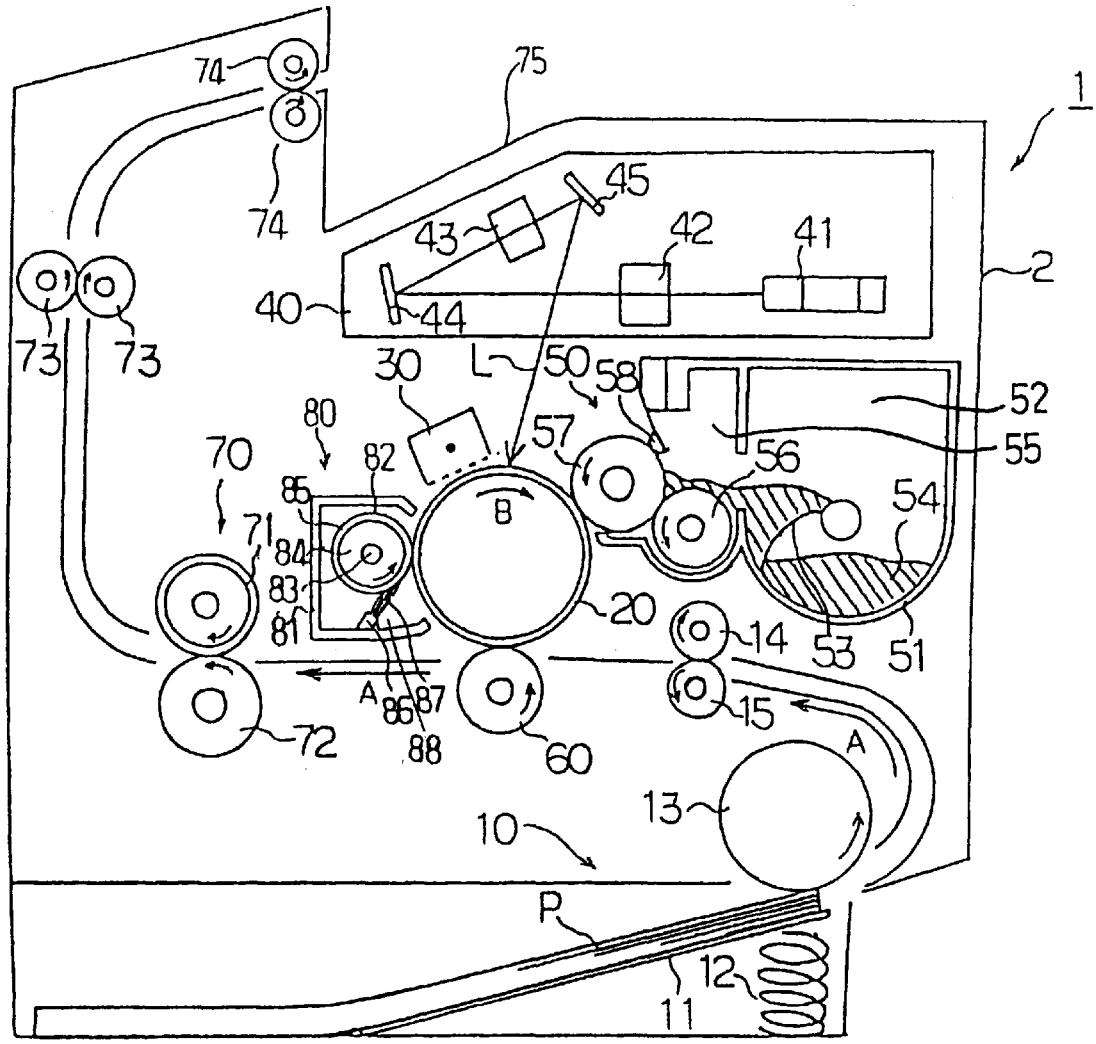
FIG. 1 is a schematic sectional view showing a configuration of an image forming apparatus according to a first embodiment of the invention.

As shown in FIG. 1, a laser beam printer 1 is provided at the bottom of a main case with a feeder unit 10 for feeding paper P. The feeder unit 10 is provided with a paper pressing plate 11, a compression spring 12, and a paper feed roller 13, and feeds, in a predetermined timed sequence, the uppermost sheet of paper P while sandwiching the sheet between the paper pressing plate 11 and the paper feed roller 13.

A pair of resist rollers 14, 15 are rotatably supported downstream from the paper feed roller 13 in the paper feed path shown by arrow A to feed the sheet of paper P in a predetermined timed sequence to a transfer position formed by a photosensitive drum 20 and a transfer roller 60.

The photosensitive drum 20 includes an organic photosensitive member mainly composed of polycarbonate which is to be positively charged. Specifically, the photosensitive drum 20 is formed of a cylindrical aluminum sleeve as a main body and a hollow drum on the outer circumference thereof. On the hollow drum, an approximately 20 $\mu$m thick light conductive layer is formed from resin-dispersed polycarbonate. The photosensitive drum 20 is rotatably supported on the main case 2 with the cylindrical sleeve being grounded, and rotationally driven by a driving means (not shown) in the direction of arrow B.

A charger 30 is of the scorotron type and discharges a corona from a charging wire made of tungsten to charge the surface of the photosensitive drum 20 uniformly to a predetermined potential.

A laser scanner unit 40 comprises a laser generator (not shown) which generates a laser beam L for forming an electrostatic latent image on the photosensitive drum 20, a polygon mirror (pentahedron mirror) 41, a pair of lenses 42, 43, and a pair of reflection mirrors 44, 45.

A toner chamber 52 is formed within a case 51 of a developing device 50. The toner chamber 52 accommodates an agitator 53 and nonmagnetic one-component toner 54 which is electrically insulative and to be positively charged. Formed on the side of the photosensitive drum 20 is a developing chamber 55 in which a toner supply roller 56 and a developing roller 57 are rotatably supported. Toner 54 on the developing roller 57 is regulated to a predetermined thickness by a layer thickness-regulating blade 58 which is thin, plate-shaped and elastic.

The transfer roller 60 is rotatably supported and made from an electrically conductive foamed elastic material, such as a silicon rubber and an urethane rubber. When a voltage is applied to the transfer roller 60, a toner image on the photosensitive drum 20 is transferred onto the sheet of paper P.

A paper dust removing roller 82 is provided within a case 81 of a paper dust remover 80. The paper dust removing roller 82 comprises an elastic roller 84 formed of a spongy material wrapped around an aluminum shaft 83 and further a non-woven cloth sheet 85 wrapped around the elastic roller 84. Provided below the paper dust removing roller 82 is a scraping member 87 in the form of a brush, which is supported on the case 81 by a support member 86 and arranged so as to make contact with the paper dust removing roller 82. The paper dust removing roller 82 is rotatably supported on the shaft 83. In this embodiment, the paper dust removing roller 82 is structured to be rotationally driven by rotation of the photosensitive drum 20. It is noted that the shaft 83 may be directly rotationally driven by a motor (not shown) via gears and the like.

A fixing unit 70 is provided downstream from the photosensitive drum 20 in the paper feed path shown by arrow A, and comprises a heat roller 71 and a pressure roller 72. When the sheet of paper P on which a transferred toner image is formed passes between the heat roller 71 and the pressure roller 72 while being sandwiched therebetween, the toner image formed on the back surface of the sheet of paper P is heated and pressed to be fixed onto the sheet of paper P.

A pair of conveying rollers 73 and a pair of paper discharge rollers 74 are provided downstream from the fixing unit 70 in the paper feed path, and a discharged paper tray 75 is provided downstream from the paper discharge rollers 74. The sheet of paper P on which the toner image is fixed by the fixing unit 70 is conveyed by the conveying rollers 73 and the paper discharge rollers 74, and finally discharged to the discharged paper tray 75.

In the laser beam printer of the embodiment described above, the surface of the photosensitive drum 20 is uniformly charged by the charger 30. Then, when the surface of the photosensitive drum 20 is irradiated with laser light L which is emitted from the laser scanner unit 40 and modulated according to image information, an electrostatic latent image is formed on the surface of the photosensitive drum 20. This electrostatic latent image is turned into a visible image by the toner 54 carried by the developing roller 57. The visible image formed on the photosensitive drum 20 is moved by the photosensitive drum 20 to the transfer position, where a sheet of paper P is fed via the feeder unit 10 and the resist rollers 14, 15. When a bias voltage is applied by the transfer roller 60 to the visible image on the photosensitive drum 20, that image is transferred onto the sheet of paper P. The toner left on the photosensitive drum 20 after image transfer is collected by the developing device 50 and reused for developing. Such a method for collecting the residual toner on the photosensitive drum 20 is disclosed in detail in U.S. Pat. No. 4,727,395, which is herein incorporated by reference.

Paper dust left on the photosensitive drum 20 is removed by the paper dust removing roller 82 which is rotationally driven by rotation of the photosensitive drum 20. At this time, the paper dust removing roller 82 is in contact with the photosensitive drum 20 by pressure produced by the elastic roller 84, and filming caused by the paper dust left on the photosensitive drum 20 is prevented. In addition, since the non-woven cloth sheet 85 is made from very fine fibers, paper dust is reliably removed. Further, the scraping member 87 is disposed beneath the paper dust removing roller 82 and is in contact therewith to remove the paper dust. The removed paper dust is scraped by the scraping member 87 and falls into a storage space 88. Thus, there is no chance that the paper dust is trapped between the paper dust removing roller 82 and the contact portion of the photosensitive drum 20. Accordingly, damage to the surface of the photosensitive drum 20 by hard pulp fibers or filming caused by soft talc can be reliably prevented.

The sheet of paper P onto which the toner image is transferred is conveyed to the fixing unit 70, and then sandwiched and further conveyed by the heat roller 71 and the paper discharge rollers 74 of the fixing unit 70. The visible image on the sheet of paper P is pressed and heated to be fixed on the sheet of paper P. Then, the sheet of paper P is discharged by the pair of conveying rollers 73 and the pair of paper discharge rollers 74 to the discharged paper tray 75 at the upper part of the laser beam printer 1, and image forming is completed.

With the laser beam printer 1 of the preferred embodiment, a high quality image can be formed through the above-described image forming operation. When nonmagnetic one-component toner is used as the toner 54, as described above, there is a problem that it is hard to form a uniform thin layer on the developing roller 57 from only normally and sufficiently charged toner in a stable manner. In this embodiment, the developing device 50 is structured, as described below, to solve such a problem and to obtained a high quality image which is free from uneven or insufficient density of toner, or fogging. The developing device 50 of this embodiment will be described below.

Figure 2:
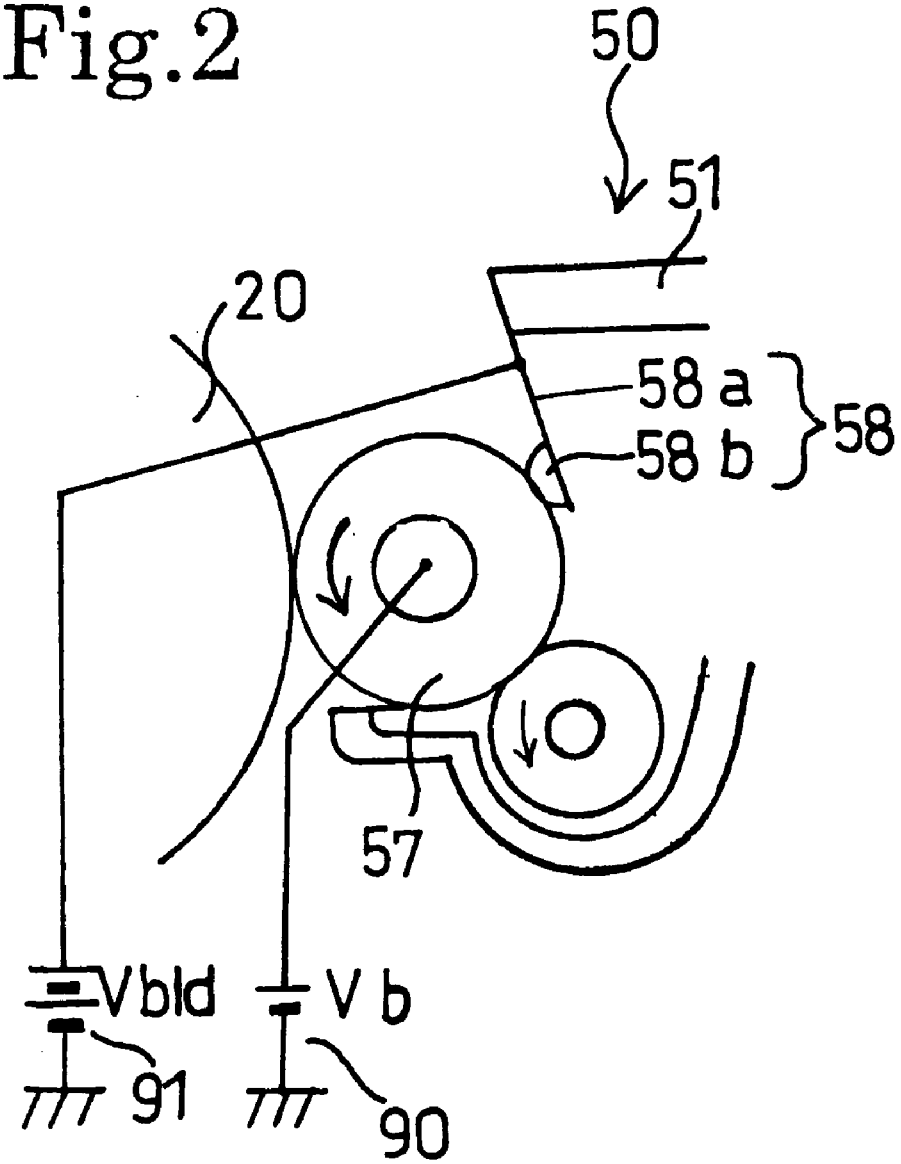
FIG. 2 is a schematic sectional view showing a configuration of a developing device of the image forming apparatus of FIG. 1.

As shown in FIG. 2, in the developing device 50, the developing roller 57 is cylindrically formed from a silicon rubber as a base material. The silicon rubber contains electrically conductive carbon fine particles. Further, a coat of fluorine-containing resin or rubber material is formed on the surface of the base material. It is noted that the base material is not limited to a silicon rubber, and an urethane rubber may, alternatively be used. The 10-point average roughness (Rz) of the developing roller 57 is set to be 3–5 $\mu$m, which is smaller than the average toner particle diameter of 8 $\mu$m. A voltage Vb is applied to the developing roller 57 by a power source 90 such that the developing roller 57 has a predetermined potential difference with respect to the photosensitive drum 20. In this embodiment, a voltage of +300 V is applied by the power source 90 to the developing roller 57.

The layer thickness-regulating blade 58 is made of stainless steel and comprises a support portion 58*a*, which is fixed, at one end thereof, to the case 51 of the developing device 50, and a contact portion 58*b*, which is provided at the tip of the support portion 58*a* and made of an electrically conductive silicon rubber, an electrically conductive fluorine-containing rubber, or an electrically conductive urethane rubber. The contact portion 58*b* is pressed into contact with the developing roller 57 elastically by the support portion 58*a*. The contact portion 58*b* is formed to be a protrusion having a generally semicircular cross section. A voltage Vbld is applied to the blade 58 by a power source 91. In this embodiment, a voltage of +500 to +600 V is applied by the power source 91 to the blade 58. The voltage Vbld generates an electric field between the blade 58 and the surface of the developing roller 57.

The toner 54 is a nonmagnetic one-component developer which is to be positively charged. Each particle of the toner 54 has a toner base particle of 6–10 μm in diameter and 8 μm on the average. The toner base particle is formed by adding a known coloring agent (carbon black in this embodiment) and a charge control additive (CCA), such as nigrosine, triphenylmethane, and quanterary ammonium salt, to a styrene acrylic resin which is spherically formed by suspension polymerization. Silica as an additive is further added to the surface of the toner base particle. Silica is treated to be hydrophobic by a known method using a silane coupling agent. The average particle diameter of silica is 10 nm and the amount of silica to be added is 0.6%, by weight, of the toner base particle. As described above, since the toner 54 is substantially spherical and suspension-polymerized, and the silica, treated to be hydrophobic, is added to the toner base particle by 0.6%, by weight, of the toner base particle, it has excellent fluidity. Accordingly, a sufficient amount of charge can be obtained by the toner 54, and efficient image transfer and high quality image forming are ensured.

The developing device 50, structured as described above, differs from conventional devices in that a coefficient of kinetic friction between the contact portion 58*b* of the blade 58 and the toner 54 is set to be greater than that between the surface of the developing roller 57 and the toner 54 so that an electric field is generated, by the action of which normally and positively charged toner 54 is moved from the blade 58 to the developing roller 57.

The toner 54 sandwiched between the contact portion 58*b* of the blade 58 and the surface of the developing roller 57 is affected by friction forces produced from the surface of the developing roller 57 and from the contact portion 58*b* of the blade 58. However, since the coefficient of friction between the contact portion 58*b* of the blade 58 and the toner 54 is set to be greater than that between the surface of the developing roller 57 and the toner 54, the friction force produced between the contact portion 58*b* of the blade 58 and the toner 54 becomes greater. Thus, without any action of an electric field generated by the voltage Vbld applied by the power source 91, the toner 54 cannot pass between the contact portion 58*b* of the blade 58 and the surface of the developing roller 57.

However, an electric field is actually generated, and when normally and positively charged toner 54 is conveyed, a force directed from the contact portion 58*b* of the blade 58 to the surface of the developing roller 57 is exerted on the normally charged toner 54 by the action of the electric field. Accordingly, the friction force produced between the contact portion 58*b* and the toner 54 is counteracted by the action of the electric field, and the toner 54 is allowed to pass between the contact portion 58*b* and the surface of the developing roller 57 to be formed into a uniform thin toner layer on the surface of the developing roller 57.

On the other hand, in the developing chamber, there may be uncharged toner or toner weakly charged to a polarity opposite to the normally charged toner, depending on the agitating condition of the toner 54. However, even when such uncharged toner or toner charged to opposite polarity is sandwiched between the contact portion 58*b* of the blade 58 and the surface of the developing roller 57, such toner is not affected by the action of the electric field. Accordingly, such toner is more affected by the friction force from the contact portion 58*b* than that from the surface of the developing roller 57, and is not allowed to pass between the contact portion 58*b* of the blade 58 and the surface of the developing roller 57.

Particularly, since the toner used in this embodiment is polymerized toner which has greater fluidity than powdered toner, it is more affected by the action of the electric field.

As described above, only normally charged toner 54 passes between the contact portion 58*b* of the blade 58 and the surface of the developing roller 57, while uncharged toner or toner charged to opposite polarity cannot pass therebetween and are not supplied to the surface of the photosensitive drum 20. As a result, since no abnormally charged toner adheres to the surface of the developing roller 57, so-called fogging can be reliably prevented and a high quality image can be obtained.

In contrast, Japanese Patent Application Publication No. 60-205472 discloses a structure in which the coefficient of friction produced between the developing roller and the toner is set to be greater than that produced between the layer thickness-regulating blade and the toner. With this structure, however, uncharged toner or toner charged to opposite polarity passes between the blade and the developing roller, and so-called fogging may occur.

Accordingly, the developing device according to the preferred embodiment is highly advantageous over the prior art in that it can produce a high quality image without fogging.

Figure 3:
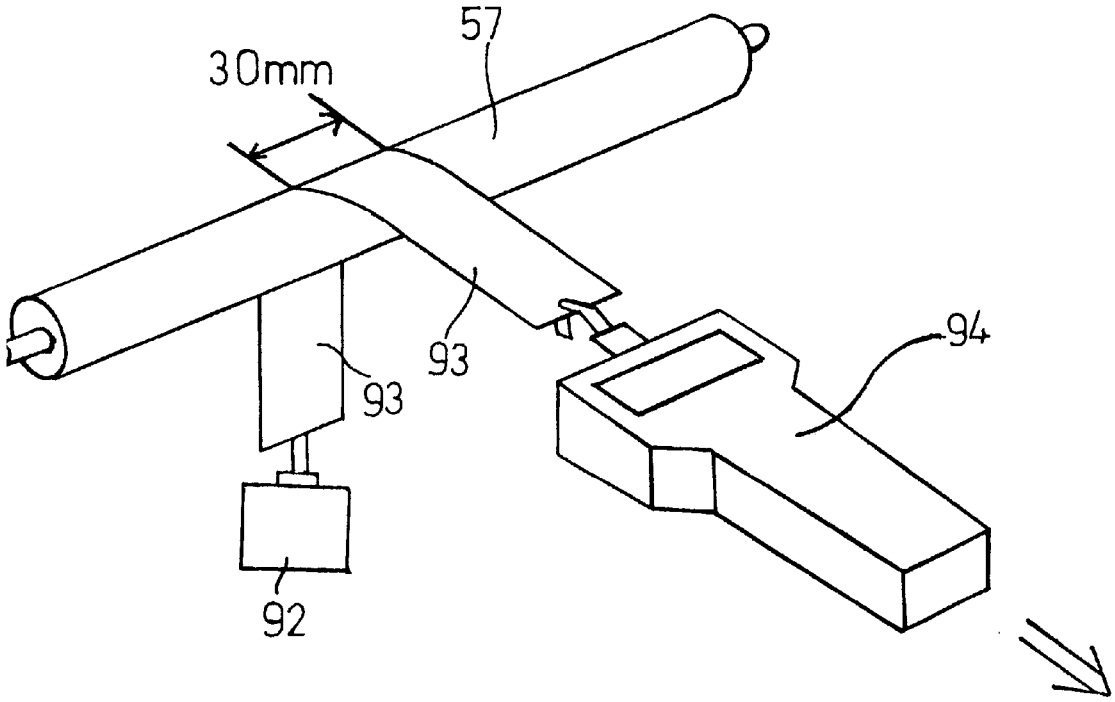
FIG. 3 is a perspective view showing a method for measuring friction forces of a developing roller and a layer thickness regulating blade according to the first embodiment.

Described below is a method for determining a difference in friction coefficient between the developing roller 57 and the regulating blade 58. In this embodiment, a friction force produced between the developing roller 57 and a stainless steel foil and that produced between the blade 58 and the stainless steel foil are measured, and based on the measured friction forces, the difference in friction coefficient is determined between the developing roller 57 and the blade 58. A method shown in FIG. 3 is used to measure friction forces. As shown in FIG. 3, a member to be measured, for example, the developing roller 57, is horizontally supported so as not to rotate. Although another measuring method, in which a planar sample to be measured is prepared, may be used, more accurate measured values can be obtained by measuring the developing roller 57 itself because the latter method is unlikely to be affected by errors caused by the surface condition which varies depending on the polishing method.

Then, a stainless steel foil 93, being 0.03 mm thick and 30 mm wide and having a weight 92 of 100 g at one end thereof, is wrapped around the developing roller 57. The weight 92 is suspended vertically from one end of the stainless steel foil 93 and a digital force gauge 94 is connected to the other end thereof. By pulling the gauge 94 gradually in the arrow direction, a force required for pulling is read by the gauge 94.

Figure 4A:
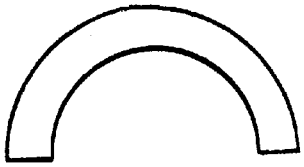
FIGS. 4A and 4B are drawings showing shapes of exemplary thickness-regulating blades applicable to the measuring method of FIG. 3.
Figure 4B:
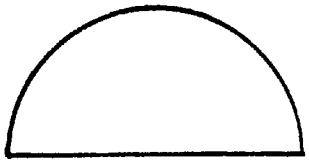

In measuring the blade 58, a sample, which is plate-shaped and made from the same material as that of the contact portion 58*b* of the blade 58, is used in place of the developing roller 57 shown in FIG. 3 and a measurement is made in the same manner as described above. The sample is bent, when measured, to the same curvature as that of the developing roller 57, as shown in FIG. 4A. Alternatively, a sample may be prepared, as shown in FIG. 4B, using a mold having the same curvature as that of the developing roller 57.

In the above-described manner, the difference in coefficient of friction against the stainless steel foil 93 is determined between the developing roller 57 and the blade 58, and materials of the developing roller 57 and the blade 58 are chosen such that the coefficient of friction of the contact portion 58*b* of the blade 58 against the stainless steel foil is greater than that of the developing roller 57.

Specifically, applying a fluorine-containing coat to the surface of the developing roller 57 is effective for reducing the friction coefficient of the developing roller 58, and using a material having rubber elasticity for the contact portion 58*b* of the blade 58 is also effective.

Although the friction coefficient of the contact portion 58*b* of the blade 58 can be increased by making its surface rough, it is noted that the additive, such as silica, added to the toner 54 functions as an abrasive and flattens the surface of the contact portion 58*b*, and thereby its surface roughness is reduced. Thus, making the surface of the contact portion 58*b* rough is pointless. Particularly, when a material having rubber elasticity is used for the contact portion 58*b*, flattening of its surface occurs at a remarkable speed. Therefore, it is important to increase the friction coefficient of the blade material itself rather than the surface roughness.

The above-described measuring method is used because the coefficient of friction produced between the developing roller 57 and the toner 54 or the blade 58 and the toner 54 is hard to measure.

In contrast, Japanese Patent Application Publication No. 60-205472, which has been mentioned as related art, discloses a method for measuring the coefficient of friction produced between the developing roller or the layer thickness-regulating blade and the toner. In this method, the toner adheres to the developing roller or the layer thickness-regulating blade, and the coefficient of friction between the toner particles will considerably affect a measurement unless a toner scraping member is provided for the developing roller and the layer thickness-regulating blade. On the other hand, if the toner scraping member is provided, the coefficient of friction between the toner scraping member and the developing roller or the layer thickness-regulating blade will affect a measurement and disable an accurate measurement.

In contrast, by use of the measuring method according to this embodiment, the difference in friction coefficient between the developing roller 57 and the contact portion 58*b* of the blade 58 can be determined accurately.

Japanese Patent Application Publication No. 60-205472 also discloses a method for measuring the coefficient of friction between toner particles. However, because the toner particles are charged and drag is generated therebetween, the friction coefficient of the toner particles is extremely small compared with that between the developing roller or the layer thickness-regulating blade and the toner.

Therefore, in this embodiment, the coefficient of friction between the toner particles is ignored and the structure of the layer thickness-regulating portion of the developing device 50 is determined based on the difference in friction coefficient between the developing roller 57 and the contact portion 58*b* of the blade 58.

In this embodiment, based on the above-mentioned measurements and surface roughness adjustment, the surface roughness Rz of the developing roller 57 is set to be 3–5 $\mu$m and that of the contact portion 58*b* of the blade 58 is set to be 5–6 $\mu$m. In addition, the average particle diameter of the toner 54 is set to be 8 $\mu$m and greater than the surface roughness of the developing roller 57. This is because, if the average particle diameter of the toner 54 is smaller than the surface roughness of the developing roller 57, toner particles might be trapped in recesses of the surface of the developing roller 57 and they might pass between the surface of the developing roller 57 and the blade 58.

It is noted that the bias voltage Vbld applied to the blade 58 by the power source 91 is not limited to the above-mentioned value, provided that the potential difference between the blade 58 and the developing roller 57 is smaller than the discharging starting voltage.

A sheet of paper may be used, instead of the stainless steel foil, for measuring the friction forces.

Although, in the above-described embodiment, the blade 58 is formed of the support portion 58*a* and the contact portion 58*b* projecting therefrom, it may be structured differently.

Figure 5:
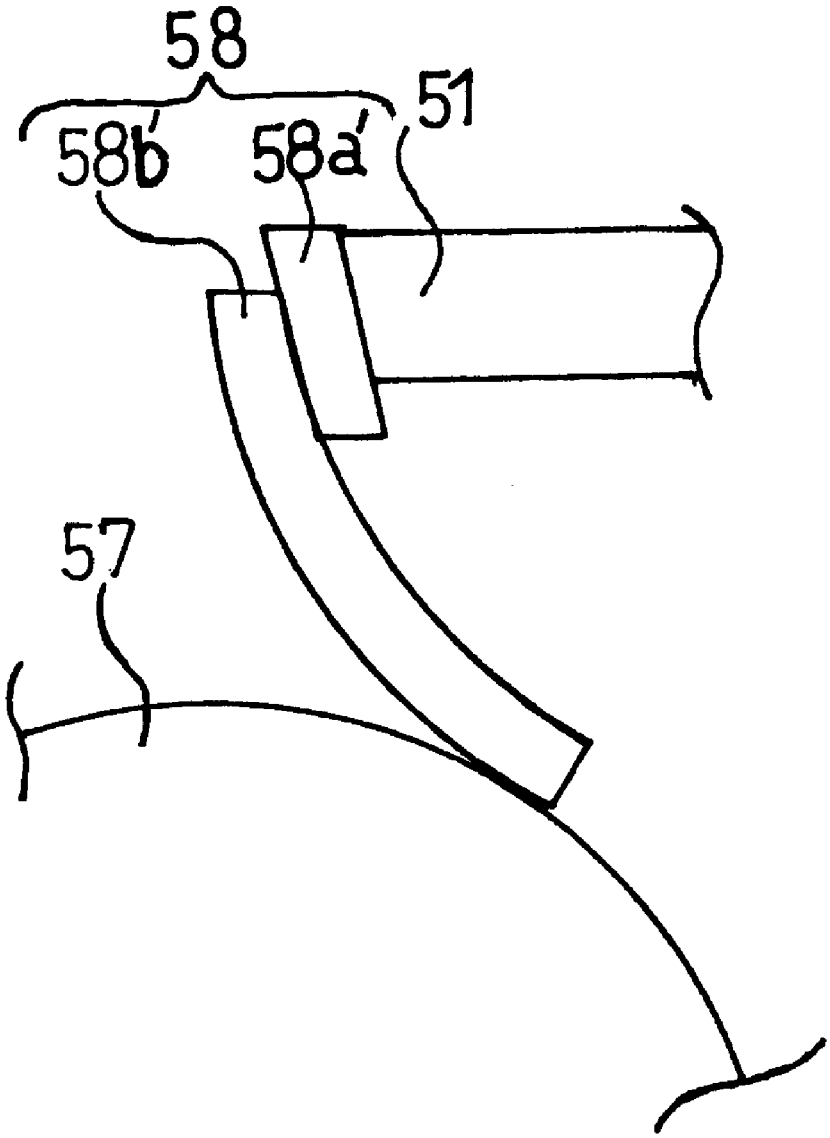
FIG. 5 is a drawing showing a modified layer thickness-regulating blade applicable to the first embodiment.

The layer thickness-regulating blade may be structured, as shown in FIG. 5. A conductive plate-shaped contact portion 58*b*' made of a silicon rubber is attached, at one end thereof, to an aluminum support portion 58*a*', and the aluminum support portion 58*a*' is attached to the case 51 of the developing device 50. A free end of the contact portion 58*b*' elastically makes surface contact with the developing roller 57. With this structure, the contact area between the contact portion 58*b*' and the developing roller 57 can be increased, and thereby uncharged toner or toner weakly charged to opposite polarity can be reduced remarkably.

Second preferred embodiment according to the invention will now be described.

Figure 6:
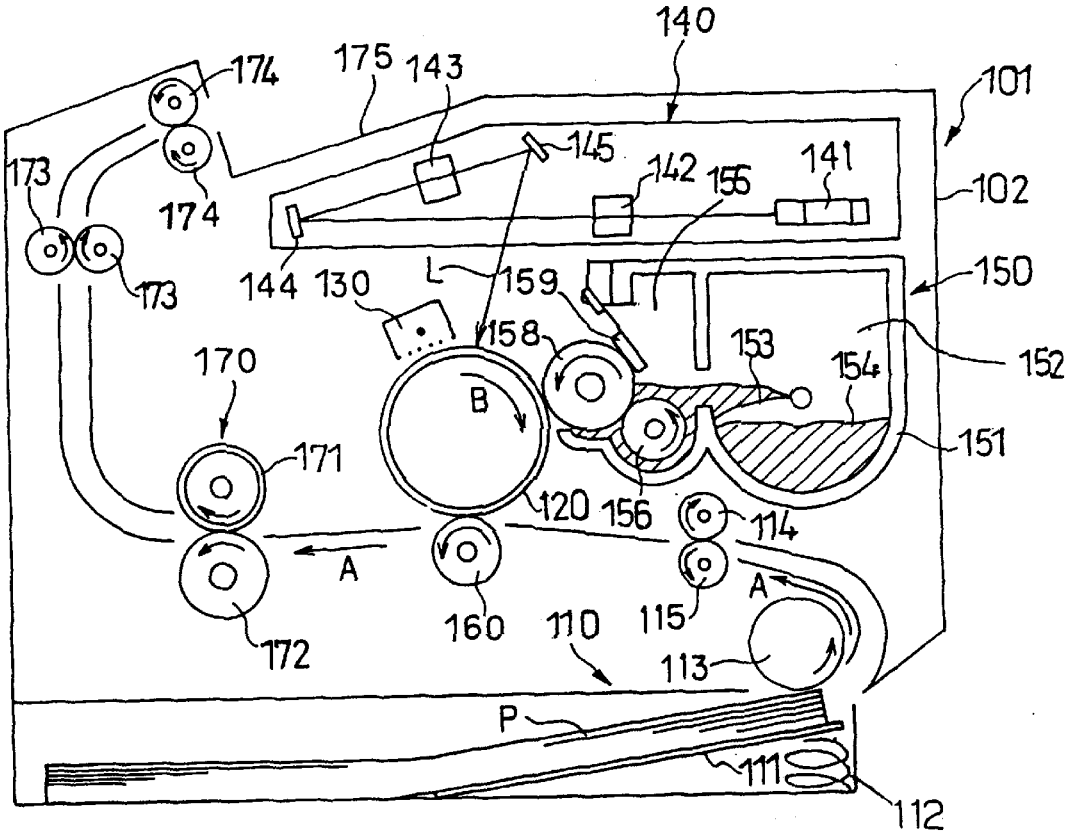
FIG. 6 is a schematic sectional view showing an image forming apparatus according to a second embodiment of the invention.

As shown in FIG. 6, a laser beam printer 101 is provided at the bottom of a main case with a feeder unit 110 for feeding paper P. The feeder unit 103 is provided with a paper pressing plate 111, a compression spring 112, and a paper feed roller 113, and feeds, in a predetermined timed sequence, the uppermost sheet of paper P while sandwiching the sheet between the paper pressing plate 111 and the paper feed roller 113.

A pair of resist rollers 114, 115 are rotatably supported downstream from the paper feed roller 113 in the paper feed path shown by arrow A to feed the sheet of paper P in a predetermined timed sequence to a transfer position formed by a photosensitive drum 120 and a transfer roller.

The photosensitive drum 120 includes an organic photosensitive member mainly composed of polycarbonate which is to be positively charged. Specifically, the photosensitive drum 120 is formed of a cylindrical aluminum sleeve as a main body and a hollow drum on the outer circumference thereof. On the hollow drum, an approximately 20 $\mu$m thick light conductive layer is formed from resin-dispersed polycarbonate. The photosensitive drum 120 is rotatably supported on the main case 102 with the cylindrical sleeve being grounded, and rotationally driven by a driving means (not shown) in the direction of arrow B.

A charger 130 is of the scorotron type and discharges a corona from a charging wire made of tungsten to charge the surface of the photosensitive drum 120 uniformly to a predetermined potential.

A laser scanner unit 140 comprises a laser generator (not shown) which generates a laser beam L for forming an electrostatic latent image on the photosensitive drum 120, a polygon mirror (pentahedron mirror) 141, a pair of lenses 142, 143, and a pair of reflection mirrors 144, 145.

A toner chamber 152 is formed within a case 151 of a developing device 150. The toner chamber 152 accommodates an agitator 153 and nonmagnetic one-component toner 154 which is electrically insulative and to be positively charged. Formed on the side of the photosensitive drum 120 is a developing chamber 155 in which a toner supply roller 156 and a developing roller 157 are rotatably supported. Toner 154 on the developing roller 157 is regulated to a predetermined thickness by a layer thickness-regulating blade 158 which is thin, plate-shaped and elastic.

A transfer roller 160 is rotatably supported and made from an electrically conductive foamed elastic material, such as a silicon rubber and an urethane rubber. When a voltage is applied to the transfer roller 160, a toner image on the photosensitive drum 120 is transferred onto the sheet of paper P.

A fixing unit 170 is provided downstream from the photosensitive drum 120 in the paper feed path shown by arrow A, and comprises a heat roller 171 and a pressure roller 172. When the sheet of paper P on which a transferred toner image is formed passes between the heat roller 171 and the pressure roller 172 while being sandwiched therebetween, the toner image formed on the back surface of the sheet of paper P is heated and pressed to be fixed onto the sheet of paper P.

A pair of conveying rollers 173 and a pair of paper discharge rollers 174 are provided downstream from the fixing unit 170 in the paper feed path, and a discharged paper tray 175 is provided downstream from the paper discharge rollers 174. The sheet of paper P on which the toner image is fixed by the fixing unit 170 is conveyed by the conveying rollers 173 and the paper discharge rollers 174, and finally discharged to the discharged paper tray 175.

In the laser beam printer of the embodiment described above, the surface of the photosensitive drum 120 is uniformly charged by the charger 130. Then, when the surface of the photosensitive drum 120 is irradiated with laser light L which is emitted from the laser scanner unit 140 and modulated according to image information, an electrostatic latent image is formed on the surface of the photosensitive drum 120. This electrostatic latent image is turned into a visible image by the toner 154 carried by the developing roller 158. The visible image formed on the photosensitive drum 120 is moved to the transfer position, where a sheet of paper P is fed via the feeder unit 103 and the resist rollers 114, 115. When a bias voltage is applied by the transfer roller 160 to the visible image on the photosensitive drum 120, that image is transferred onto the sheet of paper P. The toner left on the photosensitive drum 120 after image transfer is collected by the developing unit 150 and reused for developing. Such a method for collecting the residual toner on the photosensitive drum 120 is disclosed in detail in U.S. Pat. No. 4,727,395, which is herein incorporated by reference.

Then, the sheet of paper P onto which the toner image is transferred is conveyed to the fixing unit 170, and then sandwiched and further conveyed by the heat roller 171 and the pressure roller 172 of the fixing unit 170. The visible image on the sheet of paper P is pressed and heated to be fixed on the sheet of paper P. Then, the sheet of paper P is discharged by the pair of conveying rollers 173 and the pair of paper discharge rollers 174 to the discharged paper tray 175 at the upper part of the laser beam printer 101 and, thereby the image forming operation is completed.

In the laser beam printer 101 of this preferred embodiment, a high quality image can be formed through the above-described image forming operation. When non-magnetic one-component toner is used as the toner 154, as described above, there is a problem that it is hard to form a uniform thin layer on the developing roller 158 from only normally and sufficiently charged toner, in a stable manner. In this embodiment, the developing device 150 is structured, as described below, to solve such a problem and obtain a high quality image which is free from uneven or insufficient density, or fogging. The developing device 150 of this embodiment will be described below.

Figure 7:
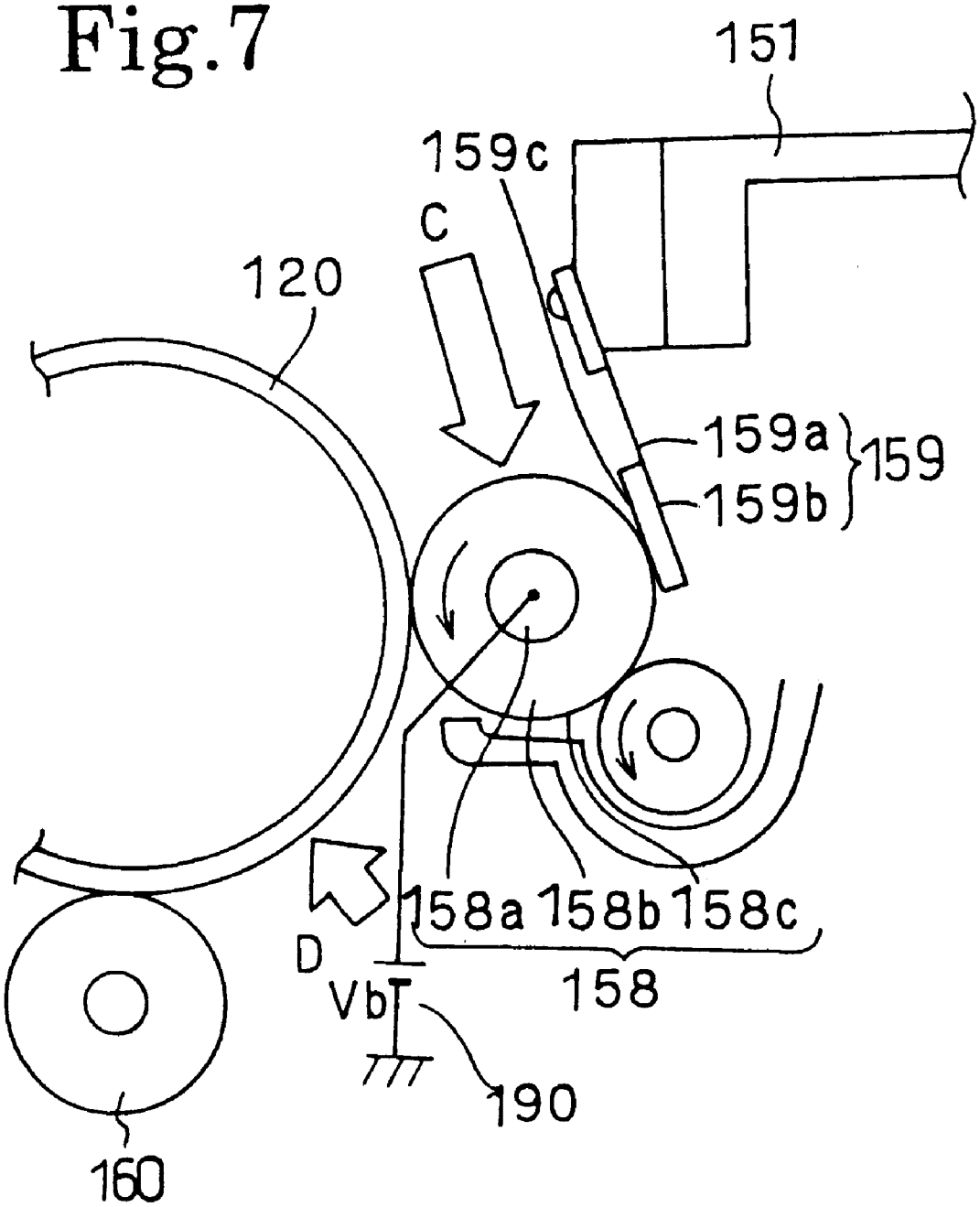
FIG. 7 is a schematic sectional view showing a configuration of a developing device of the image forming apparatus of FIG. 6.

As shown in FIG. 7, in the developing device 150, the developing roller 158 has a metal shaft 158*a* at its center and is formed to be cylindrical from a silicon rubber 158*b*, as a base material, in which electrically conductive carbon fine particles are dispersed. Further, on the surface of the silicon rubber, a coat of resin or rubber material 158*c*, which contains electrically conductive carbon fine particles as well as fluorine, is formed. Resistance of the developing roller 158 should be equal to or smaller than $10^7$ Ω when a voltage of 1 kV is applied between the surface of the developing roller 158 and the metal shaft 158*a*. When the developing roller 158 has a resistance of $10^7$ Ω or lower, the coat 158*c* may be electrically insulative. It is noted that the base material is not limited to a silicon rubber, and an urethane rubber may be used alternatively. The 10-point average roughness (Rz) of the developing roller 158 is set to be 3–5 μm, which is smaller than the average toner particle diameter of 8 μm. A voltage Vb is applied to the developing roller 158 by a power source 190 such that the developing roller 158 has a predetermined potential difference with respect to the photosensitive drum 120. In this embodiment, a voltage of +600 V is applied by the power source 190 to the developing roller 158.

The layer thickness-regulating blade 159 is made of stainless steel and comprises a support portion 159*a*, which is fixed, at one end thereof, to the case 151 of the developing device 150, and a contact portion 159*b*, which is provided at the tip of the support portion 159*a* and made of an electrically insulative silicon rubber. The contact portion 159*b* is pressed into contact with the developing roller 158 elastically by the support portion 159*a*. The contact portion 159*b* is formed to be plate-shaped in cross section, as shown in FIG. 7.

The toner 154 is a nonmagnetic one-component developer which is to be positively charged and each particle of the toner 154 has a base particle of 6–10 μm in diameter and 8 μm on the average. Silica, as an additive, is further added to the surface of the toner base particle. Silica is treated to be hydrophobic by a known method using a silane coupling agent. The toner 154 is made by adding to the toner base particle silica having a BET value of 200 by 1.0% and silica having a BET value of 50 by 0.5%, by weight, of the toner base particle.

The BET value indicates a specific surface area obtained by measuring a particle while nitrogen is adsorbed to the particle, and is represented in terms of area per unit weight ($m^2/g$). Therefore, as the BET value increases, a particle diameter decreases, and as the BET value decreases, a particle diameter increases. In this embodiment, BET values are measured by a typical BET measuring method and using the FlowSorb 2-2300, a specific surface area measuring instrument made by Shimazu Seisakusyo.

As described above, since the toner 154 is substantially spherical and suspension-polymerized, and silica having a BET value of 200 and treated to be hydrophobic is added to the toner base particle by 1.0%, by weight, of the toner base particle, it has excellent fluidity. Accordingly, a sufficient amount of charge can be obtained by the toner 154, and efficient image transfer and high quality image forming are ensured. In addition, since silica having a BET value 50 prevents silica having a BET value 200 from being buried in the toner base particle, excellent fluidity is maintained, and efficient image transfer and high quality image forming are ensured over a long period of time.

Nigrosine is used for the toner 154 as a charge control additive (CCA) and the absolute value of Q/M (amount of charge per unit weight) is adjusted to 30 μC/g or more.

The developing device 150 of this embodiment, structured as described above, differs from conventional devices in the following points:

A coefficient of friction μb between the contact portion 159*b* of the blade 159 and the toner 154 is set to be greater than the coefficient of friction μr between the surface of the developing roller 158 and the toner 154, and further the coefficient of friction μr is set to be greater than the coefficient of friction μi between the toner particles.

The contact portion 159*b* of the blade 159 is formed to be electrically insulative and the surface of the developing roller 158 is formed to be electrically conductive.

In this embodiment, due to these structural differences, uncharged toner or toner charged to polarity opposite to the normally charged toner are not allowed to pass between the blade 159 and the developing roller 158, while normally charged toner 154 is attracted to the developing roller by an image force produced between the developing roller 158 and the toner 154, and is allowed to pass between the blade 159 and the developing roller 158.

The toner 154 supplied between the developing roller 158 and the blade 159 is affected by the friction force from the developing roller 158 and that from the blade 159. The toner 154 is not a single particle but formed of layers of toner particles having a predetermined thickness. Accordingly, toner particles directly affected by the friction force from the developing roller 158 are also affected by that from other toner particles, while toner particles directly affected by the friction force from the regulating blade 159 are also affected by that from other toner particles. Among the toner particles constituting the layers, some of them are only affected by other toner particles.

In such situations, on the assumption that no other forces than the friction forces are exerted on the toner 154, when the coefficient of friction $\mu b$ between the contact portion 159*b* of the blade 159 and the toner 154 is set to be greater than the coefficient of friction $\mu r$ between the surface of the developing roller 158 and the toner 154, and further the coefficient of friction $\mu r$ is set to be greater than the coefficient of friction $\mu i$ between the toner particles, toner particles being in contact with the surface of the developing roller 158 are affected, as the developing roller 158 rotates, by the friction force from the developing roller 158, which is greater than that from the other toner, and are held and carried by the developing roller 158. On the other hand, toner particles in contact with the contact portion 159*b* of the blade 159 are affected by the friction force from the contact portion 159*b*, which is greater than that from other toner 154, and are stopped from moving.

As for the toner particles in the intermediate layers away from the developing roller 158 and the contact portion 159*b*, the coefficient of friction between the toner particles is the same at any position, but the friction force exerted on each toner particle varies depending on its position. The friction force becomes greater as the toner particle gets closer to the surface of the developing roller 158, and smaller as the particles gets closer to the contact portion 159*b*. Accordingly, the toner layers will shear and will be divided into toner particles carried by the rotation of the developing roller 158 as it rotates and those stopped from moving.

The toner layers, if sheared repeatedly in this way, finally become a single layer which makes contact with both the surface of the developing roller 158 and the contact portion 159*b* of the blade 159. However, because the coefficient of friction $\mu b$ between the contact portion 159*b* of the blade 159 and the toner 154 is greater than the coefficient of friction $\mu r$ between the surface of the developing roller 158 and the toner 154, the toner 154 is not allowed to pass between the blade 159 and the developing roller 158.

Actually, however, when positively charged toner 154 is conveyed between the developing roller 158 and the blade 159, a charge opposite in polarity to the positively charged toner 154 is induced on the conductive surface of the developing roller 158 and an electrostatic image force is produced between the positively charged toner 154 and the negative charge. On the other hand, because the contact portion 159*b* of the blade 159 is electrically insulative, even when it makes contact with the positively charged toner 154, no charge is induced to attract the positively charged toner to the blade 159. In other words, an image force that directs the positively charged toner 154 from the developing roller 158 to the blade 159 is sufficiently small.

Due to such a difference in image force, as far as the normally charged toner 154 is concerned, vertical drag produced between the developing roller 158 and the toner 154 becomes sufficiently greater than that produced between the blade 159 and the toner 154. Accordingly, the friction force exerted on the positively charged toner 154 from the contact portion 159*b* of the blade 159 is counteracted. As a result, due to the friction force between the toner carrying surface of the developing roller 158 and the toner 154, the normally charged toner 154 passes between the blade 159 and the developing roller 158, and a thin toner layer is formed on the surface of the developing roller 158.

Particularly, since the toner 154 in this embodiment is polymerized toner which is excellent in fluidity, it is well affected electrostatically. Further, because the toner 154 is adjusted by adding the charge control additive so that the absolute value of Q/M of the toner 154 is as high as 30 $\mu$C/g or more, an image force directed from the blade 159 to the developing roller 158 becomes sufficiently great. Thus, the toner 154 passes smoothly between the blade 159 and the developing roller 158, and a toner layer is formed on the surface of the developing roller in a uniform thickness.

In contrast, as an insufficient image force toward the developing roller 158 is exerted on toner charged to opposite polarity or uncharged toner, such toner is greatly affected by the friction force from the contact portion 159*b* of the blade 159 and is not be allowed to pass between the blade 159 and the developing roller 158.

In addition, because the 10-point average roughness (Rz) of the developing roller 158 is set to be smaller than the average toner particle diameter, no uncharged toner or toner that is weakly charged to opposite polarity is carried forcibly by the developing roller 158. Specifically, abnormally charged toner particles are prevented from being trapped in recesses of the surface of the developing roller 158 and carried to the surface of the photosensitive drum 120. Thus, only normally charged toner can pass smoothly between the blade 159 and the developing roller 158.

As described above, only normally charged toner 154 passes between the contact portion 159*b* of the blade 159 and the surface of the developing roller 158, while uncharged toner or toner charged to opposite polarity is stopped from being supplied to the surface of the photosensitive drum 120. As a result, since no abnormally charged toner adheres to the surface of the developing roller 158, so-called fogging can be reliably prevented and a high quality image can be obtained.

In contrast, Japanese Patent Application Publication No. 60-205472 discloses a structure in which the coefficient of friction produced between the developing roller and the toner is set to be greater than that produced between the layer thickness-regulating blade and the toner. With this structure, however, uncharged toner or toner charged to opposite polarity passes between the blade and the developing roller, and so-called fogging may occur.

Accordingly, the developing device according to the preferred embodiment is highly advantageous over the prior art in that it can produce a high quality image without fogging.

Described below is a method for determining a difference in friction coefficient between the developing roller 158 and the blade 159. In this embodiment, a friction force produced between the developing roller 158 and a stainless steel foil and that produced between the blade 159 and the stainless steel foil are measured, and based on the measured friction forces, the difference in friction coefficient is determined between the developing roller 158 and the blade 159.

Figure 8:
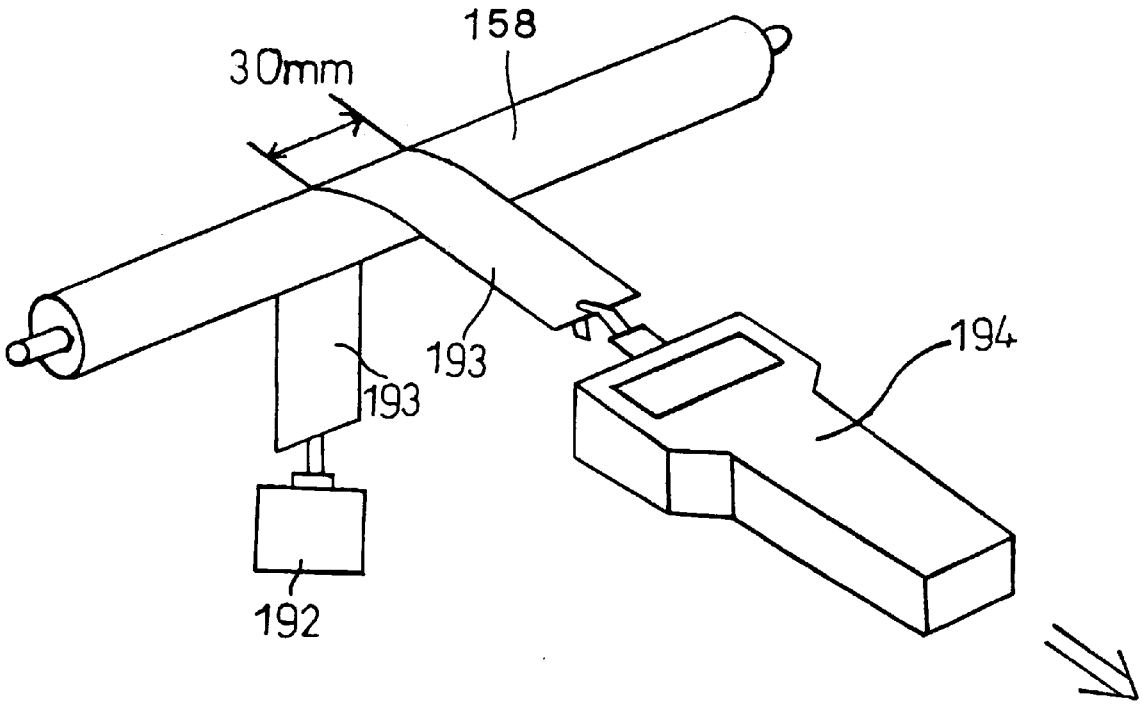
FIG. 8 is a perspective view showing a method for measuring friction forces of a developing roller and a layer thickness regulating blade according to the second embodiment.

A method as shown in FIG. 8 is used to measure friction forces. As shown in FIG. 8, a member to be measured, for example, the developing roller 158 is horizontally supported so as not to rotate. Although another measuring method, in which a planar sample to be measured is prepared, may be used, more accurate measured values can be obtained by measuring the developing roller 158 itself because the latter method is unlikely to be affected by errors caused by the surface condition which varies depending on the polishing method.

Then, a stainless steel foil 193, being 0.03 mm thick and 30 mm wide and having a weight 192 of 100 g at one end thereof, is wrapped around the developing roller 158. The weight 192 is suspended vertically from one end of the stainless steel foil 193 and a digital force gauge 194 is connected to the other end thereof. By pulling the gauge 194 gradually in the direction of the arrow, a force required for pulling can be read from the gauge 194.

Figure 9A:
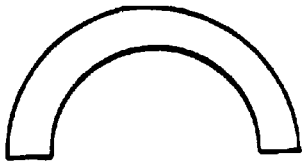
Figure 9B:
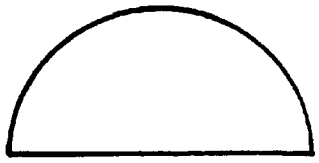

In measuring the blade 159, a sample, which is plate-shaped and made from the same material as that of the contact portion 159*b* of the blade 159, is used in place of the developing roller 158 shown in FIG. 8 and a measurement is made in the same manner as described above. This sample is bent, when measured, to the same curvature as that of the developing roller 158, as shown in FIG. 9A. Alternatively, a sample may be prepared, as shown in FIG. 9B, using a mold having the same curvature as that of the developing roller 158.

The coefficient of friction of toner particles is measured by the same method as shown in FIG. 8 by preparing a stainless steel foil 193, or similar sheet material, such as plastic film, to which toner is applied using a double-sided adhesive tape and similarly applying double-sided adhesive tape to a metal cylinder and then applying toner. The metal cylinder is as large as the developing roller 158. Thus, the toner on the stainless steel foil 193 opposes the toner on the metal cylinder and a toner on toner coefficient of friction is obtained.

In the above-described manner, the difference in coefficient of friction against the stainless steel foil is determined between the developing roller 158 and the blade 159, the materials of the developing roller 158 and the blade 159 are chosen such that the coefficient of friction of the contact portion 159*b* of the blade 159 against the stainless steel foil is greater than that of the developing roller 158.

Specifically, applying a fluorine-containing coat to the surface of the developing roller 158 is effective for reducing the coefficient of friction of the developing roller 158, and using a material having rubber elasticity for the contact portion 159*b* of the blade 159 is also effective for increasing the coefficient of friction of the contact portion 159*b* thereby ensuring the coefficient of friction of the contact portion is greater than the coefficient of friction of the developing roller 158.

Although the coefficient of friction of the contact portion 159*b* of the blade 159 can be increased by making its surface rough, it is noted that the additive, such as silica, added to the toner 154 functions as an abrasive and flattens the surface of the contact portion 159*b*, and thereby its surface roughness is reduced. Thus, making the surface of the contact portion 159*b* rough is nonproductive. Particularly, when a material having rubber elasticity is used for the contact portion 159*b*, flattening of its surface is remarkable. Therefore, it is important to increase the coefficient of friction of the blade material itself rather than the surface roughness.

The above-described measuring method is used because the coefficient of friction produced between the developing roller 158 and the toner 154 or the blade 159 and the toner 154 is hard to measure.

In contrast, Japanese Patent Application Publication No. 60-205472, which has been identified as related art, discloses a method for measuring the coefficient of friction produced between the developing roller or the layer thickness-regulating blade and the toner. In this method, the toner adheres to the developing roller or the layer thickness-regulating blade, and the coefficient of friction between the toner particles will greatly affect a measurement unless a toner scraping member is provided for the developing roller and the layer thickness-regulating blade. On the other hand, if the toner scraping member is provided, the coefficient of friction between the toner scraping member and the developing roller or the layer thickness-regulating blade will affect measurement and preclude accurate measurement.

In contrast, by use of the measuring method according to this embodiment, the difference in the coefficients of friction between the developing roller 158 and the contact portion 159*b* of the blade 159 can be determined accurately.

In addition, since a material having rubber elasticity is used for the contact portion 159*b* of the blade 159, the surface of the developing roller 158 will not be damaged. Further, since the toner 154 is not pressed against the surface of the developing roller 158 excessively, the toner 154 will be slow to deteriorate and an excellent developing process is performed over a long period of time.

One example of experiments conducted using the laser beam printer 101 of the second embodiment will be described below. In this example of an experiment, polymerized toner was prepared by suspension polymerization. Toner having an average particle diameter of 8 $\mu$m was used as the toner 154. Specifically, black toner made by adding carbon, wax, and a charge control additive to a styrene acrylic resin, was used. Nigrosine was used as a charge control additive, and the amount of charge of the toner was controlled by adjusting the amount of the charge control additive. As additives for the toner, an additive having a BET value of 200 and that having a BET value of 50 were added in amounts of 1.0% and 0.5%, by weight, respectively. By use of the above-described polymerized toner, the coefficient of friction between toner particles could be reduced.

Used as the layer thickness-regulating blade 159 was a blade formed of a stainless steel leaf spring as the support portion 159*a* and a silicon rubber as the contact potion 159*b*, which was integrally formed with the support portion 159*a*. The contact surface 159*c*, having 2 mm thick plated-shaped cross section, of the contact portion 159*b*, was made to contact with the developing roller 158.

Used as the developing roller 158 was a roller formed of a base member made of an urethane rubber with conductive carbon fine particles dispersed, and a coat containing conductive carbon fine particles and fluorine. The 10-point average roughness of the surface of the developing roller 57 was 3 $\mu$m. By providing such a fluorine-containing coat, the coefficient of friction $\mu r$ between the surface of the developing roller 158 and the toner 154 could be made smaller than the coefficient of friction $\mu b$ between the contact portion 159*b* of the blade 159 and the toner 154.

The toner 154 on the developing roller 158 was sucked using a Faraday gauge in the position shown by a hollow arrow C of FIG. 7 and its Q/M was measured by a normal measuring method.

The degree of fogging on the photosensitive drum 20 was measured as described below. Blank printing, that is, printing without print data was performed and forcibly terminated in the middle. Then, the toner adhering to the position shown by a hollow arrow D was collected using a transparent tape. Then, the toner-collected transparent tape was affixed to a sheet of white paper, and a piece of transparent tape without toner, as a comparative sample, was affixed to a sheet of the same white paper. The reflection coefficient of each of the samples was measured to determine the difference therebetween. The difference in reflection coefficient is preferably not greater than 1.

The results of the experiment are shown in FIG. 11. It is apparent from FIG. 11 that with increases in Q/M of the toner 154 on the developing roller 158, Nigrosine content as a charge control additive increases, and the degree of fogging on the photosensitive drum 120 decreases. It is also readily understood that in order to obtain the desired degree of fogging, which is 1.0 or less, the Q/M of the toner on the developing roller 158 should be adjusted to 30 $\mu$C/g or more.

One example of experiments conducted for making a comparison with the above-described experiment will be described below. The conditions of the experiment were the same as in the above-described experiment except that the contact portion 159*b* of the layer thickness-regulating blade 159 was provided with a coat of fluorine-containing urethane rubber. The urethane rubber as a base material is the same material as that of the developing roller 158

In this experiment, the coefficient of friction between the contact portion 159*b* of the layer thickness-regulating blade 159 and the toner 154 was substantially equal to that between the developing roller 158 and the toner 154. FIG. 10 shows the results of this experiment, and FIG. 12 shows a comparison between the results of above-described experiment and the comparative experiment.

Figure 12:
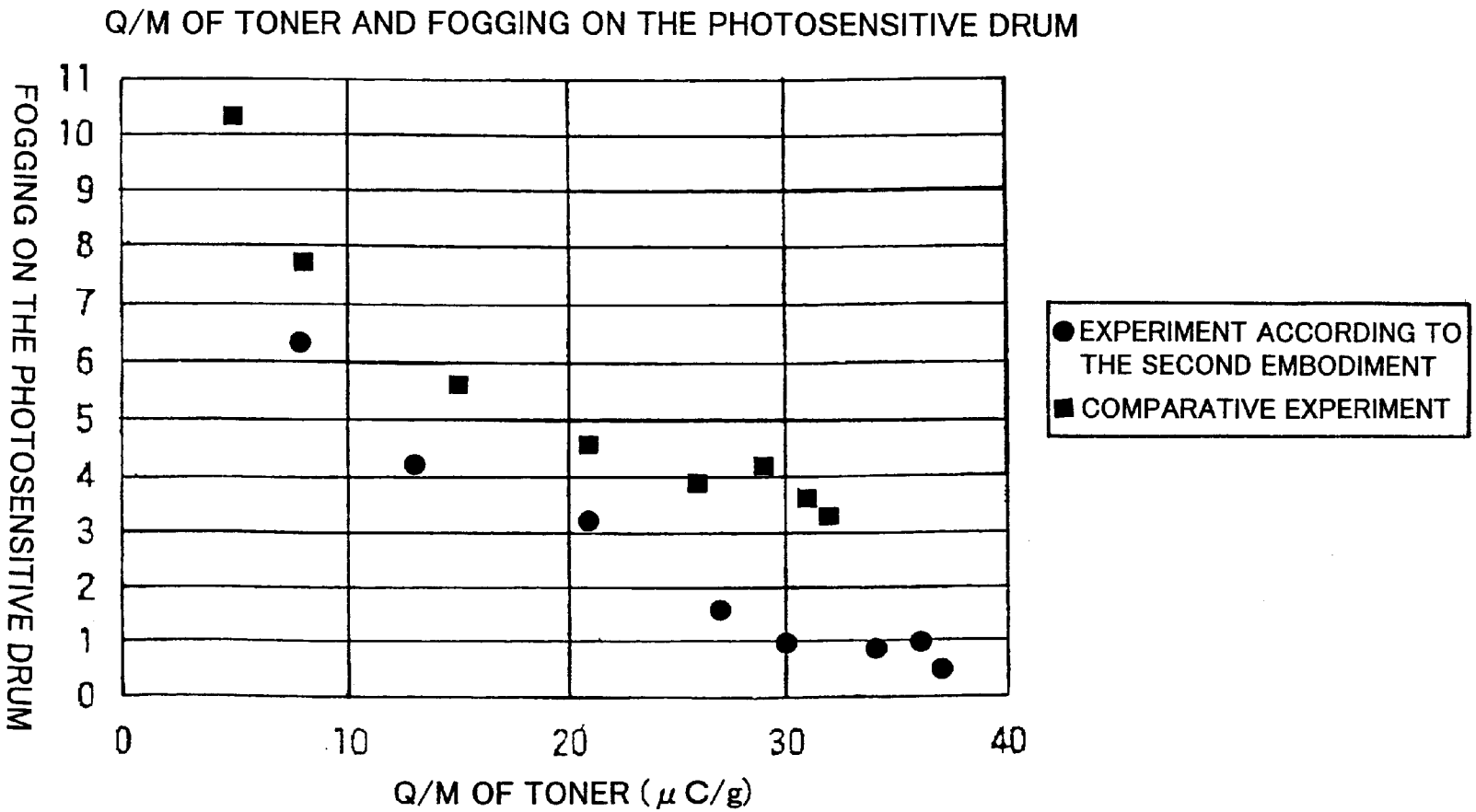
FIG. 12 is a graph showing a comparison between the results of FIG. 10 and the results of FIG. 11.

It is apparent from FIGS. 10 and 12 that the degree of fogging on the photosensitive drum 120 in the comparative experiment is as high as 3.0 or more even when the Q/M of the toner on the developing roller 158 is set to be 30 $\mu$C/g or more.

Since the coefficient of friction between the contact portion 159*b* of the layer thickness-regulating blade 159 and the toner 154 was lowered to equate to that between the developing roller 158 and the toner 154, a friction force to stop uncharged toner or toner charged to opposite polarity from passing through the developing roller 158 and the blade 159 was not obtained. Thus, such abnormally charged toner was conveyed from the developing roller 158 to the photosensitive drum 120.

In this embodiment, as is apparent from the above-described experiments, since a sufficient and proper image force is not produced between the developing roller 158 and uncharged toner or toner charged to opposite polarity, such abnormally charged toner are affected by the friction force from the contact portion 159*b* of the blade 159 and not allowed to pass the developing roller 158 and the blade 159.

On the other hand, because a sufficient and proper image force is produced between the developing roller 158 and normally and positively charged toner 154, the toner 154 is affected by the friction force from the surface of the developing roller 158 and allowed to pass between the blade 159 and the developing roller 158. As a result, a high quality image can be formed while so-called fogging is greatly reduced.

Figure 13:
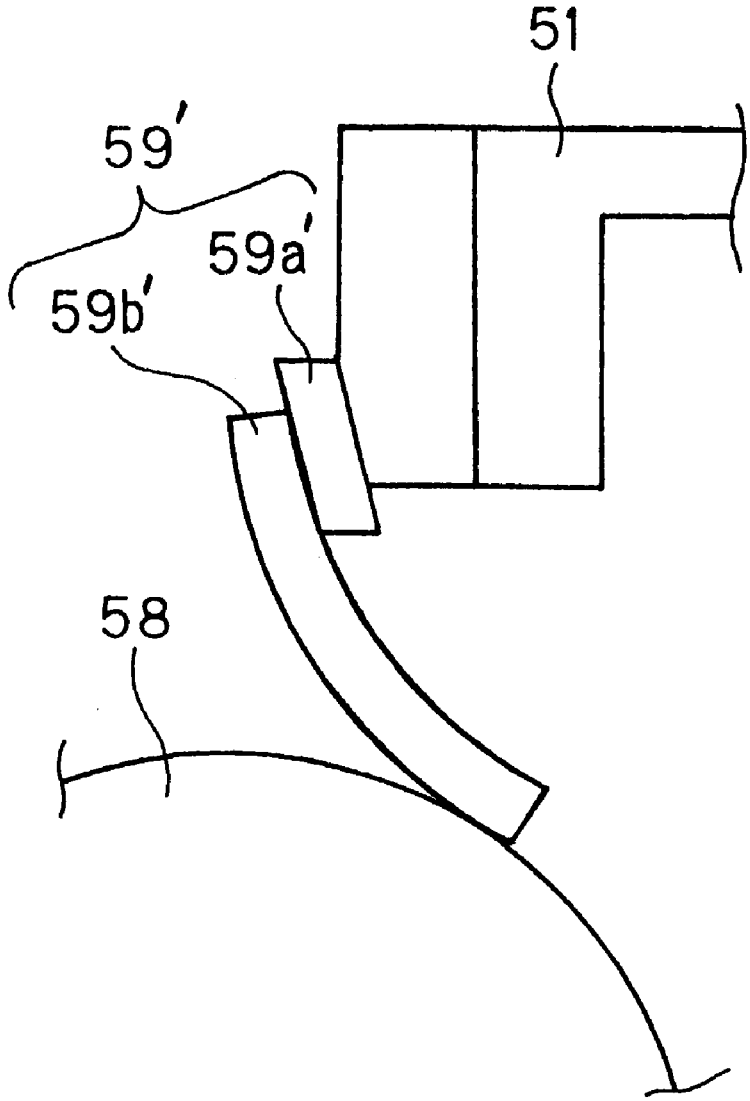
FIG. 13 is a drawing showing a modified layer thickness-regulating blade applicable to the second embodiment.

Although, in the above-described embodiment, the contact portion 159*b* is provided in a projecting manner on the support portion 159*a* of the blade 159, the blade 159 may be structured differently. The layer thickness-regulating blade 59' may be structured as shown in FIG. 13. A plate-shaped contact portion 59*b*' made of a silicon rubber is attached, at one end thereof, to an aluminum support portion 59*a*', and the aluminum support portion 59*a*' is attached to the case 51 of the developing device 50. A free end of the contact portion 59' elastically makes surface contact with the developing roller 58.

With this structure, the contact area between the contact portion 59*b*' and the developing roller 58 can be increased, and thereby uncharged toner or toner charged to opposite polarity can be remarkably reduced.

Although the above-described embodiment of the invention is described as applied to the laser beam printer 101, the invention may be applied to other image forming apparatuses, such as a copy machine, in which an electrostatic latent image is formed by a laser beam reflected from the original document. Further, the invention may be applied to an image forming apparatus using emulsion-polymerized toner, instead of suspension-polymerized toner, as the nonmagnetic one-component toner.

When emulsification-polymerized toner is used, relatively high fluidity can be obtained, and thus the same advantages as in the above-described embodiment can be obtained.

Although, in the above-described embodiment, positively charged toner is used, negatively charged toner may be used.

What is claimed is:

1. An image forming apparatus, comprising:

a developer carrying member for carrying on a surface thereof a nonmagnetic one-component developer;

a layer thickness-regulating member for regulating a thickness of a layer of the nonmagnetic one-component developer carried by the developer carrying member; and a power source for generating an electric field which applies a force directed from the layer thickness-regulating member to the developer carrying member, wherein a coefficient of friction between the layer thickness-regulating member and the nonmagnetic one-component developer is greater than a coefficient of friction between the surface of the developer carrying member and the nonmagnetic one-component developer.

2. The image forming apparatus according to claim 1, wherein the layer thickness-regulating member is in surface contact with the developer carrying member.

3. The image forming apparatus according to claim 1, wherein the layer thickness-regulating member is an electrically conductive member having rubber elasticity.

4. The image forming apparatus according to claim 1, wherein 10-point average roughness of the developer carrying member is smaller than an average particle size of the nonmagnetic one-component developer.

5. The image forming apparatus according to claim 1, wherein the nonmagnetic one-component developer is polymerized toner.

6. The image forming apparatus according to claim 1, wherein the layer thickness-regulating member comprises:

a support portion; and a contact portion, mounted along one edge of the support portion, having a curved outer surface providing a semicircular cross section.

7. The image forming apparatus according to claim 6, wherein the contact portion is made of an electrically conductive material chosen from a group consisting of silicon rubber, fluorine containing rubber, and urethane rubber.

8. An image forming apparatus, comprising:

a developer carrying member made from an electrically conductive material for carrying a nonmagnetic one-component developer; and a layer thickness-regulating member for regulating a thickness of a layer of nonmagnetic one-component developer carried by the developer carrying member, the layer thickness-regulating member having a contact portion made from an electrically insulative material which makes contact with the nonmagnetic one-component developer, wherein a coefficient of friction between a surface of the developer carrying member and the nonmagnetic one-component developer is greater than a coefficient of friction between particles of the nonmagnetic one-component developer, and the coefficient of friction between a surface of the contact portion and the nonmagnetic one-component developer is greater than a coefficient of friction between the surface of the developer carrying member and the nonmagnetic one-component developer.

9. The image forming apparatus according to claim 8, wherein even when the surface of the contact portion becomes worn by slidingly making contact with the nonmagnetic one-component developer, the coefficient of friction between the surface of the contact portion and the nonmagnetic one-component developer is greater than that between the surface of the developer carrying member and the nonmagnetic one-component developer.

10. The image forming apparatus according to claim 8, wherein an absolute value of an amount of charge of the nonmagnetic one-component developer on the developer carrying member is not smaller than 30 $\mu$C/g.

11. The image forming apparatus according to claim 8, wherein the nonmagnetic one-component developer is polymerized toner.

12. The image forming apparatus according to claim 8, wherein the layer thickness-regulating member has rubber elasticity.

13. The image forming apparatus according to claim 8, wherein 10-point average roughness of the developer carrying member is smaller than an average particle size of the nonmagnetic one-component developer.

14. The image forming apparatus according to claim 8, wherein the layer thickness-regulating member comprises:

a support portion; and a contact portion, mounted along one edge of the support portion and being plate shaped.

15. The image forming apparatus according to claim 14, wherein the contact portion is made of electrically insulative silicon rubber.

16. The image forming apparatus according to claim 1, wherein the layer thickness regulating member comprises:

an aluminum support portion; and an electrically conductive plate-shaped contact portion mounted to the support portion.

17. The image forming apparatus according to claim 8, wherein the layer thickness regulating member comprises:

an aluminum support portion; and an insulative plate-shaped contact portion mounted to the support portion.

18. An image forming apparatus, comprising:

a developer carrying member for carrying on a surface thereof a nonmagnetic one-component developer;

a layer thickness-regulating member for regulating a thickness of a layer of the nonmagnetic one-component developer carried by the developer carrying member; and a power source for generating an electric field which applies a force directed from the layer thickness-regulating member to the developer carrying member, wherein a coefficient of friction between the layer thickness-regulating member and the nonmagnetic one-component developer is greater than a coefficient of friction between the surface of the developer carrying member and the nonmagnetic one-component developer and even when the surface of the layer thickness-regulating member becomes worn by slidingly making contact with the nonmagnetic one-component developer, the coefficient of friction between the surface of the layer thickness-regulating member and the nonmagnetic one-component developer is greater than that between the surface of the developer carrying member and the nonmagnetic one-component developer.

19. An image forming apparatus, comprising:

a developer carrying member made from an electrically conductive material for carrying a nonmagnetic one-component developer; and a layer thickness-regulating member for regulating a thickness of a layer of nonmagnetic one-component developer carried by the developer carrying member, the layer thickness-regulating member having a contact portion made from an electrically insulative material which makes contact with the nonmagnetic one-component developer, wherein a coefficient of friction between a surface of the developer carrying member and the nonmagnetic one-component developer is greater than a coefficient of friction between particles of the nonmagnetic one-component developer, and the coefficient of friction between a surface of the contact portion and the nonmagnetic one-component developer is greater than a coefficient of friction between the surface of the developer carrying member and the nonmagnetic one-component developer, wherein even when the surface of the contact portion becomes worn by slidingly making contact with the nonmagnetic one-component developer, the coefficient of friction between the surface of the contact portion and the nonmagnetic one-component developer is greater than that between the surface of the developer carrying member and the nonmagnetic one-component developer.

20. An image forming apparatus, comprising:

a developer carrying member made from an electrically conductive material for carrying a nonmagnetic one-component developer; and a layer thickness-regulating member for regulating a thickness of a layer of nonmagnetic one-component developer carried by the developer carrying member, the layer thickness-regulating member having a contact portion made from an electrically insulative material which makes contact with the nonmagnetic one-component developer, wherein a coefficient of friction between a surface of the developer carrying member and the nonmagnetic one-component developer is greater than a coefficient of friction between particles of the nonmagnetic one-component developer, and the coefficient of friction between a surface of the contact portion and the nonmagnetic one-component developer is greater than a coefficient of friction between the surface of the developer carrying member and the nonmagnetic one-component developer, wherein an absolute value of an amount of charge of the nonmagnetic one-component developer on the developer carrying member is not smaller than 30 $\mu$C/g.

* * * * *